United States Patent [19]

Reuter

[11] Patent Number: 5,076,337

[45] Date of Patent: Dec. 31, 1991

[54] MAIL ARRIVAL ALERT FOR MAILBOX

[76] Inventor: Robert Reuter, 1205 Hilltop Dr., Naples, Fla. 33940

[21] Appl. No.: 522,044

[22] Filed: May 11, 1990

[51] Int. Cl.[5] ..... B65D 91/00

[52] U.S. Cl. ..... 160/35; 160/34

[58] Field of Search ..... 232/35, 34

[56] References Cited

U.S. PATENT DOCUMENTS

| | | | |
|---|---|---|---|
| 1,458,836 | 6/1923 | McDowell | 232/35 |
| 3,482,543 | 12/1969 | Guidos | 232/35 |
| 3,516,383 | 6/1974 | Goodman | 232/35 |
| 4,491,268 | 1/1985 | Faulkingham | 232/35 |
| 4,896,624 | 1/1990 | Carnwath | 232/35 |

*Primary Examiner*—Blair M. Johnson

*Attorney, Agent, or Firm*—Merrill N. Johnson

[57] ABSTRACT

A simplified attachment for a mailbox which alerts the mailbox addressee that mail has been delivered. The attachment includes a signal flag mounted on a spring activated spool rotatably secured within a housing affixed to the side of the mailbox. When the mailbox door is closed, the upper end of the signal flag is held under tension in a horizontal position by a keeper mounted on the door of the mailbox. When the mailbox door is opened, the signal flag is released from its horizontal position and, powered by the spring, rises to a vertical position above the mailbox to alert the addressee that the mail has arrived.

5 Claims, 1 Drawing Sheet

MAIL ARRIVAL ALERT FOR MAILBOX

BACKGROUND AND SUMMARY OF THE INVENTION

The invention relates to conventional mailboxes which are usually mounted on a post beside the road by homeowners or mailbox addressees who live in houses located away from but within sight of the roadside mailbox.

In order to alert the homeowner or addressee of the arrival of mail delivered to the box, numerous devices and attachments to the mailbox have been proposed, very few of which have appeared on the market. See, for example, U.S. Pat. Nos. 2,551,915; 2,812,130: 2,874,896; 4,202,486: and 4,390,122.

It is my opinion that the lack of public acceptance of prior mailbox alert devices lies in their failure to provide a simple, reliable device at a low price and which can be easily installed by the homeowner himself.

I have invented a simple, reliable, easily installed and operated mailbox alert assembly which has only one moving part and should last as long as the mailbox itself.

Briefly stated, my mailbox alert assembly includes a weather-proof flag on the upper end of a flag pole or shaft. The flag pole's lower end is mounted on the side of a cylindrical spool which is rotatably journalled within a housing affixed to the side wall of the mailbox. A coiled spring is wound around the spool and the base of the flag pole so that when the flag pole is in a vertical position with the flag visible over the top of the mailbox, the spring is not under tension but when the flag pole is pushed down into the horizontal position along side the wall of the mailbox, it is under tension.

My mail alert assembly includes a simple inverted U-shaped keeper mounted on the door of the mailbox and designed to receive the uppermost end of the flag pole and thus keep the flag pole under tension in its horizontal position until the door is open. When the mailbox door is opened by the mailman to deposit mail in the box, the keeper is pulled out of engagement with the flag pole, which then, driven by the spring under tension, pivots into its vertical position.

DETAILED DESCRIPTION OF THE PREFERRED EMBODIMENT

Figure 1:
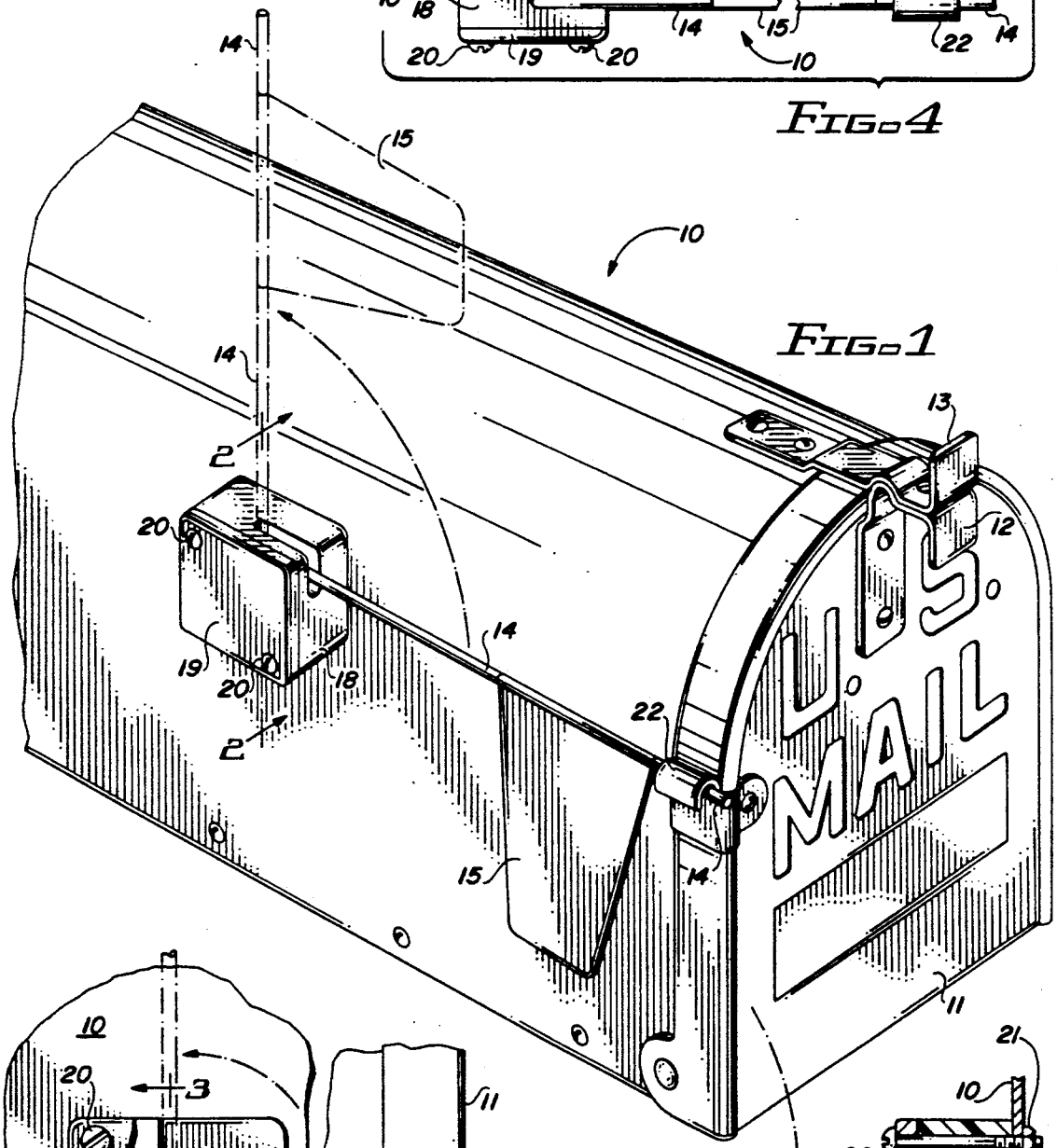
FIG. 1 is a perspective view taken from the side of a conventional mailbox fitted with a preferred form of my mail arrival alert attachment.

Referring to the drawings, FIG. 1 shows a conventional mailbox 10 which has been fitted with a preferred form of my mailbox alert attachment or assembly. Box 10 consists of a one piece curved top and side walls, a one piece bottom, a closed rear panel, and a door 11 hinged to the bottom of box 10. A finger operated latch 12 is mounted on the top of door 11. Latch 12 mates with a keeper 13 mounted on the top of mailbox 10 to keep door 11 in a normally closed position.

My mail arrival alert assembly includes a brightly colored flag 15 preferably made of weather-proof plastic material mounted on the upper end of a flag pole 14 preferably made of corrosion resistant steel. The lower end of pole 14 is securely affixed to a cylindrical spool 16 preferably made of high impact resistant metal or plastic material.

Figure 3:
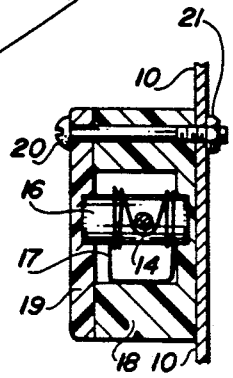
FIG. 3 is a cross-sectional view of the attachment taken along line 2—2 of FIG. 1.

Spool 16 is journalled for free rotation about its axis in two cylindrical holes in respectively housing 18 and housing cover 19 as best shown in FIG. 3. Housing 18 and housing cover 19 are preferably made of high impact resistant plastic material or metal to promote virtually frictionless turning of spool 16 and prevent deterioration of the housing and its cover by sun, rain, salt spray and blowing dust and dirt.

Figure 4:
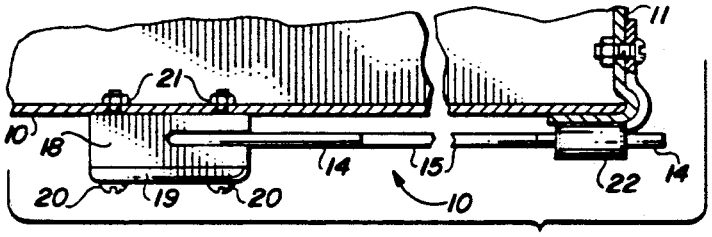
FIG. 4 is a detailed plan view taken from above showing the mounting of my mail arrival alert attachment onto the side of the mailbox shown in FIG. 1.

Housing 18 is attached to the side wall of box 10 by preferably two corrosion resistant bolts 20 and nuts 21 as best shown in FIGS. 3 and 4.

Spool 16 is spring loaded to rotate so as to place flag pole 14 in a vertical or upright position so that flag 15 is displayed over the top of mailbox 10. This is accomplished by a specially designed coiled spring 17 shown in FIGS. 2 and 3. The two ends of spring 17 rest on the bottom of the chamber within housing 18 and as best shown in FIG. 3 the spring is coiled around both spool 16 and the lower end of pole 14.

When flag pole 14 is in its upright position, it is under virtually no tension from spring 17, but when the pole is pushed downwardly into a horizontal position along the side wall of box 10 as best shown in FIG. 1, it is under considerable tension and if not restrained will rotate back to its upright position.

Figure 2:
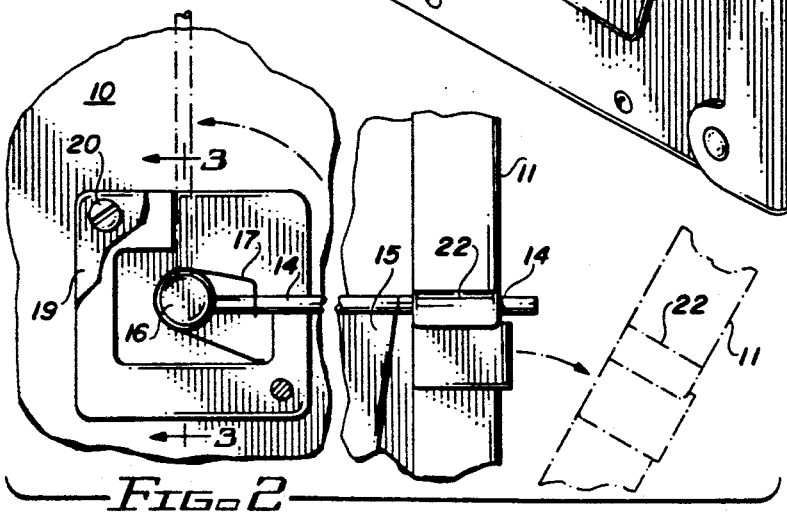
FIG. 2 is a partially cut away detailed view taken from the side of the attachment shown in FIG. 1.

When mailbox door 11 is in its normally closed position as shown in FIG. 1, flag pole 14 and flag 15 are restrained in their horizontal position by keeper 22 attached to the side of door 11 as best shown in FIGS. 1 and 2. Keeper 22 may take different forms but is preferably in the shape of an inverted U which receives the uppermost end of flag pole 14 so that, as shown in FIG. 2 in dotted lines, as the door is opened to receive mail, keeper 22 moves out of engagement with pole 14. Pole 14, then being free, is propelled into its vertical position by the action of spring 17.

While I have shown and described a preferred embodiment of my unique mail arrival alert attachment for a mailbox, various modifications and rearrangements will be apparent to those skilled in the art without departing from the spirit and scope of my invention and no limitation thereof should be implied by the foregoing description. The scope of my invention is limited only by the appended claims.

I claim:

1. A mail arrival alert assembly for mounting on a conventional mailbox with a hinged front door, said assembly comprising an enclosed housing mounted on the side of the mailbox, a cylindrical spoon journalled for rotation within the housing, a flag pole whose lower end is affixed to the spool and whose other end when in a vertical position extends above the top of the mailbox and when in a horizontal position extends slightly beyond the front door of the mailbox when the door is in its closed position, a flag attached to the upper end of the flag pole, a double torsion spring coiled about the spool and whose center section is looped about the lower end of the flag pole and arranged so that the flag pole in its vertical position is under virtually no tension from the spring but in its horizontal position along side the mailbox is under tension from the spring to return to its vertical position, and a keeper attached to the mailbox door positioned to mate with the end of the flag pole and restrain the pole in its horizontal position with the door is in its closed position, whereby when the mailbox door is opened and the pole is not longer restrained, the double torsion spring causes the spool and pole to rotate and move the flag pole into its vertical position.

2. A mail arrival alert assembly as set forth in claim 1 in which the housing is made of corrosion resistant plastic material.

3. A mail arrival alert assembly as set forth in claim 1 in which the flag is made from a sheet of flexible brightly colored plastic material.

4. A mail arrival alert assembly as set forth in claim 1 in which the flag pole is a rod of corrosion resistant steel.

5. A mail arrival alert assembly as set forth in claim 1 in which the keeper attached to the mailbox door is made of corrosion resistant metal and is in the form of an inverted U.

* * * * *